US006158958A

United States Patent [19]

Heer

[11] Patent Number: 6,158,958

[45] Date of Patent: Dec. 12, 2000

[54] CENTRIFUGAL PUMP

[75] Inventor: Siegfried Heer, Kirchdorf/Krems, Austria

[73] Assignee: TCG Unitech Aktiengesellschaft, Krems, Austria

[21] Appl. No.: 09/268,675

[22] Filed: Mar. 16, 1999

[30] Foreign Application Priority Data

Mar. 16, 1998 [AT] Austria ..... 463/98

[51] Int. Cl.[7] ..... F04D 29/42

[52] U.S. Cl. ..... 415/200; 415/203; 415/214.1

[58] Field of Search ..... 415/200, 203, 415/204, 206, 214.1, 213.1, 229, 230, 170.1

[56] References Cited

U.S. PATENT DOCUMENTS 4,052,133 10/1977 Yeater ..... 415/200
5,697,767 12/1997 Bissell et al. ..... 417/350

FOREIGN PATENT DOCUMENTS 0208074 1/1987 European Pat. Off. .
3316927 11/1984 Germany .
4319618 12/1994 Germany .
2047341 11/1980 United Kingdom .

*Primary Examiner*—Edward K. Look
*Assistant Examiner*—Liam McDowell
*Attorney, Agent, or Firm*—Dykema Gossett PLLC

[57] ABSTRACT

A centrifugal pump includes an impeller which is attached to a drive shaft, a multipart pump housing which is partly made of plastic material and contains an intake chamber positioned on the drive side of the impeller and a spiral-shaped pressure chamber, a bearing support disposed in the region of the intake chamber being made of metallic material, and the pump housing is provided with an intake flange on the drive side and a housing cover in the region of the pressure chamber. In order to reduce weight and manufacturing cost, the intake chamber is bounded on the one hand by the bearing support and on the other hand by a housing part which is made of plastic material and surrounds the bearing support to which it is connected, preferably so as to be detachable.

11 Claims, 1 Drawing Sheet

Fig.1
(PRIOR ART)
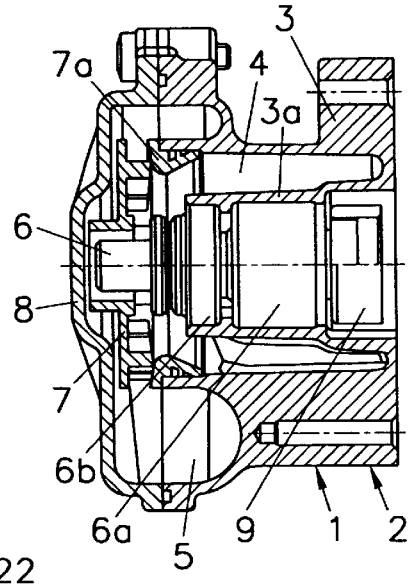
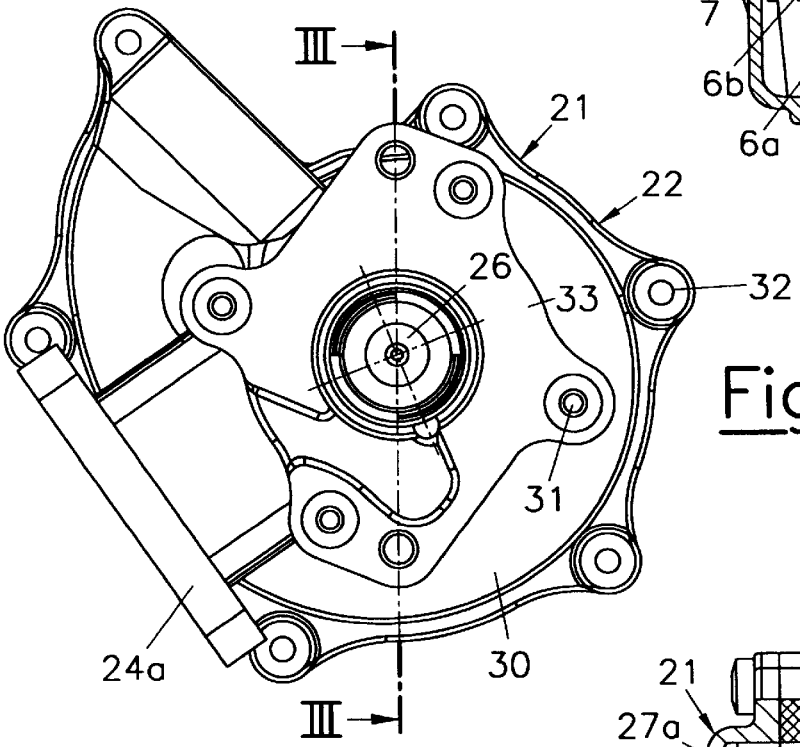
Fig.3
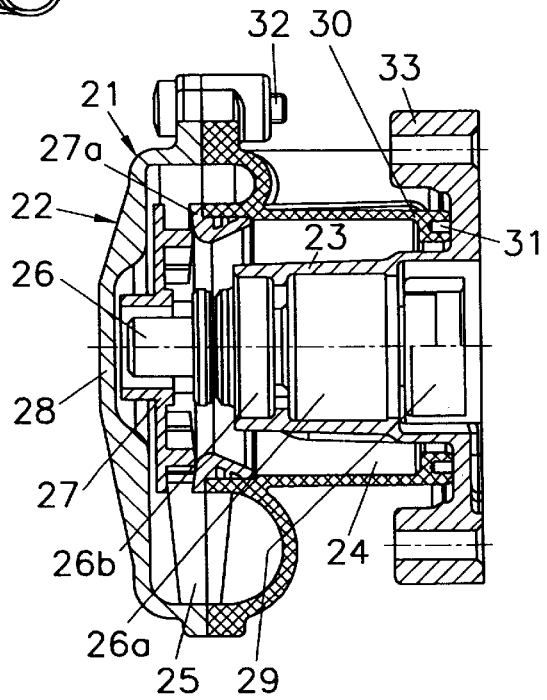
Fig.2

CENTRIFUGAL PUMP

BACKGROUND OF THE INVENTION

The invention relates to a centrifugal pump with an impeller which is attached to a drive shaft, and a multipart pump housing which is partly made of plastic material and contains an intake chamber positioned on the drive side of the impeller and a spiral-shaped pressure chamber, a bearing support disposed in the region of the intake chamber being made of metallic material and the pump housing being provided with an intake flange on the drive side and a housing cover in the region of the pressure chamber.

DESCRIPTION OF THE PRIOR ART

In conventional centrifugal pumps of the above type, and water pumps in particular, the intake chamber, at least part of the pressure chamber, and the bearing support for the drive shaft are constituted by a single component made of metal. Whilst such pumps are robust, the high density of the metallic pump housing will add to the overall weight of the pump. This, together with the increased manufacturing cost in the instance of more intricate housing geometries, is undesirable.

The descriptions presented in EP 208 074 A, DE 33 16 927 A, and DE 43 19 618 A refer to pumps which are partly made of plastic materials. The general feature of such pumps is a metal housing part containing the motor bearing assembly, etc., to which is attached a spiral case made of plastic, which surrounds the impeller. Although it is possible in this manner to gain a certain reduction in weight and cost, such solutions require considerable space. In automotive vehicles, however, where such pumps are used for handling the cooling water, the available space naturally is quite limited.

SUMMARY OF THE INVENTION

It is an object of the invention to avoid drawbacks of the above kind and to reduce the total weight and manufacturing expense of a centrifugal pump as described above.

According to the invention this object is achieved by providing that the intake chamber be bounded on the one hand by the bearing support and on the other hand by a housing part which is made of plastic material and surrounds the bearing support to which it is connected preferably so as to be detachable.

Housing parts which are subject to lesser thermal stresses or mechanical loads are thus made of plastics. Due to the low density of these materials the total weight of the pump may be reduced significantly. The bearing support, which has to cope with higher thermal and mechanical loads, consists of metal, preferably aluminium, magnesium, or an aluminium or magnesium alloy, which will permit rapid dissipation of the bearing heat.

Due to the special configuration of the centrifugal pump of the invention the available space is utilized in the best possible way. Moreover, the materials from which the individual components are made are perfectly matched to the loads to which these components are subject. In this manner considerable savings in material and costs can be made.

Preferably, it is provided that the housing cover be made of plastic. It is provided in a particularly cost-effective, low-weight variant that the housing cover form an integral unit with the housing part constituting at least part of the intake chamber. Housing cover and housing part may be fabricated by investment molding, for example.

Further weight reduction is obtained by making the intake flange of plastic material and molding it integrally with the housing part constituting at least part of the intake chamber.

Special preference is given to a variant in which the bearing support is provided integral with a mounting flange on the drive side, to which flange the housing part constituting at least part of the intake chamber is detachably fastened. This will permit a variety of spiral geometries to be combined with different bearing supports. The bearing support could also be permanently attached to the housing part.

BRIEF DESCRIPTION OF THE DRAWING

The invention will now be further described with reference to the accompanying drawing, in which FIG. 1 is a longitudinal section of a conventional centrifugal pump, FIG. 2 is a longitudinal section of a centrifugal pump as decribed by the invention, FIG. 3 is a plan view of the centrifugal pump, seen from the side of the mounting flange.

FIG. 1 shows a conventional centrifugal pump 1 with a pump housing 2 including a metal housing part 3 which provides the bearing support 3*a*, the intake chamber 4, and part of the spiral-shaped pressure chamber 5. The intake chamber 4 surrounds the bearing support 3*a*. On the side of the impeller 7 driven by the drive shaft 6, the housing part 3 is covered by a housing cover 8. Reference number 9 refers to a coupling connected to the drive shaft 6. The drive shaft 6 is held in the bearing support 3*a* via a plain bearing 6*a*. The bearing 6*a* is separated from the intake chamber 4 by means of a mechanical shaft seal 6*b*. On the entry side of the impeller 7 a suction mouth 7*a* is provided, which rotates together with the impeller and constitutes a flow-optimizing adapter of the cross-section between intake chamber 4 and the entry area of the impeller 7. The metal housing part 3 is a pressure die-cast component whose large wall thicknesses will increase the overall weight of the pump.

The centrifugal pump 21 shown in FIGS. 2 and 3 features a pump housing 22 which is made from a combination of several materials. The bearing support 23 is configured as a separate part made of metal, and is used for holding the drive shaft 26. The intake chamber 24 and pressure chamber 25 are formed by a housing part 30 made of plastic, which is connected to the bearing support 23 by fastening screws 31. In the region of the impeller 27 a housing cover 28 is attached to the housing part 30, which cover 28 also consists of plastic. The housing part 30 and the cover 28 are connected by fasteners 32.

A mounting flange 33 is formed integrally with the bearing support 23, which flange 33 serves as a mounting plate for the centrifugal pump 21 in addition to receiving the fastening screws 31 for the housing part 30.

The drive shaft 26 is held in the bearing support 23 via a bearing 26*a*, which may be configured as a roller bearing. The metal bearing support 23 will not only take up the bearing forces of the drive shaft 26 but will also carry off the bearing heat most satisfactorily.

Reference number 27*a* refers to a suction mouth on the entry side of the impeller 27. Between bearing 26*a* and suction mouth 27*a* or intake chamber 24 a mechanical shaft seal 26*b* is disposed. A drive assembly not shown here may be connected to coupling 29.

The intake flange 24*a* may conveniently be provided as an integral unit with the housing part 30 and hence be formed of plastic. Manufacture of the plastic housing part 30, which is advantageously made by injection molding, is considerably less expensive than that of the die-cast housing part 3 presented in FIG. 1. Moreover, complex structural geometries of the housing part 30 are more reliably obtained with the use of plastic molding techniques than with metal casting.

A suitable plastic material for the housing part 30 and the housing cover 28 would be Ryton with a density of 1.98 g/ccm, for example.

The bearing support 23 is conveniently made from aluminium, or magnesium, or a suitable aluminium or magnesium alloy.

Since one and the same bearing support 23 may be used for a variety of housing parts 30 and spiral geometries, a large number of design varieties are made possible at minimum manufacturing expense.

The type of centrifugal pump described by the invention will permit cost reductions of up to 50 percent and weight reductions of up to 30 percent over conventional centrifugal pumps with metal cases.

I claim:

1. Centrifugal pump with an impeller which is attached to a drive shaft, and a multipart pump housing which is partly made of plastic material and defines an intake chamber positioned on a drive side of the impeller and a spiral-shaped pressure chamber, a bearing support which is made of metallic material, an intake flange on the drive side, a housing cover in the region of the pressure chamber, and a housing part which is made of plastic material and surrounds the bearing support to which it is connected so as to be detachable, said bearing support and said housing part defining the intake chamber therebetween.

2. Centrifugal pump as claimed in claim 1, wherein the housing cover is made of plastic.

3. Centrifugal pump as claimed in claim 2, wherein the housing cover forms an integral unit with the housing part constituting part of the intake chamber.

4. Centrifugal pump as claimed in claim 1, wherein the intake flange consists of plastic material and is formed integrally with the housing part constituting part of the intake chamber.

5. Centrifugal pump as claimed in claim 1, wherein the bearing support is formed integral with a mounting flange on the drive side, to which flange the housing part constituting at least part of the intake chamber is fastened so as to be detachable.

6. Centrifugal pump as claimed in claim 1, wherein the bearing support is made of one of metal of the group consisting of aluminium, magnesium, and an aluminium or magnesium alloy.

7. Centrifugal pump as claimed in claim 1, wherein the intake chamber has the shape of a ring surrounding the bearing support on the outside, and wherein the housing part is essentially concentric to the bearing support.

8. Centrifugal pump as claimed in claim 1, wherein the housing part defines part of the pressure chamber.

9. A centrifugal pump which comprises:

a multipart housing which includes a first housing part made of metal that defines an annular bearing support, and a second housing part made of plastic that extends from a first end removably attached to said first housing part and around said annular bearing support to a second end that forms a first portion of a spiral pressure chamber, said annular bearing support and said second housing part defining an annular intake chamber therebetween, a cover which is made of plastic and is attached to said second end of said second housing part to form a second portion of said spiral pressure chamber, a drive shaft which is mounted within said annular bearing support by a bearing and mounts an impeller which rotates to move fluid in said spiral pressure chamber.

10. A centrifugal pump according to claim 9, including screws which connect said first end of said second housing part to said first housing part.

11. A centrifugal pump according to claim 9, wherein said first housing part defines a mounting flange for mounting said pump to a support.

* * * * *

UNITED STATES PATENT AND TRADEMARK OFFICE

CERTIFICATE OF CORRECTION

PATENT NO. : 6,158,958

DATED : December 12, 2000

INVENTOR(S) : Siegfried HEER

It is certified that error appears in the above-indentified patent and that said Letters Patent is hereby corrected as shown below:

On the title page item
[73] Assignee: TCG Unitech Aktiengesellschaft
Kirchdorf/Krems, Austria

Signed and Sealed this

Third Day of April, 2001

*Attest:*

Nicholas P. Godici

NICHOLAS P. GODICI

*Attesting Officer*

*Acting Director of the United States Patent and Trademark Office*